United States Patent [19]

Adams et al.

[11] 3,980,544

[45] Sept. 14, 1976

[54] APPARATUS AND METHOD FOR SECURING A FABRICATED DIAPHRAGM TO ELECTRODES IN AN ELECTROLYTIC CELL

[75] Inventors: John O. Adams, Englewood; Kenneth E. Woodard, Jr.; Steven J. Specht, both of Cleveland, all of Tenn.

[73] Assignee: Olin Corporation, New Haven, Conn.

[22] Filed: July 14, 1975

[21] Appl. No.: 595,976

[52] U.S. Cl. ..... 204/286; 204/253; 204/267; 204/288; 204/289

[51] Int. Cl.[2] ..... C25B 9/02; C25B 1/26

[58] Field of Search ..... 204/275, 266, 283, 288, 204/297 R, 252, 255, 279, 226, 267, 252, 253, 281, 286

[56] References Cited

UNITED STATES PATENTS

| | | | |
|---|---|---|---|
| 1,513,728 | 11/1924 | Allan | 204/286 X |
| 1,963,363 | 6/1934 | Hale | 204/286 |
| 3,779,889 | 12/1973 | Loftfield | 204/269 X |
| 3,900,384 | 8/1975 | Gunby | 204/286 |

*Primary Examiner*—John H. Mack
*Assistant Examiner*—A. C. Prescott
*Attorney, Agent, or Firm*—H. Samuel Kieser; Donald F. Clements; James B. Haglind

[57] ABSTRACT

Apparatus is provided for securing a fabricated diaphragm to each of a section of electrodes. A diaphragm encloses each electrode and has an open end adjacent to the electrode plate. The apparatus comprises two bars, one positioned along a first side and one positioned along a third side of the electrode section. A plurality of elements are attached to each of the bars. The elements are positioned between adjacent electrodes and secure one edge of each of two adjacent diaphragms. The elements may be interconnected to provide additional sealing of the diaphragm. A rod is positioned along the second and fourth sides of the electrode section to seal the outer edge of the diaphragm enclosing the external electrodes of the section.

The apparatus is employed in electrolytic diaphragm cells for producing chlorine and caustic soda by the electrolysis of alkali metal chloride solutions.

A method is provided for employing the apparatus to effectively seal the diaphragm to the electrode section.

12 Claims, 4 Drawing Figures

APPARATUS AND METHOD FOR SECURING A FABRICATED DIAPHRAGM TO ELECTRODES IN AN ELECTROLYTIC CELL

The invention relates to diaphragm electrolytic cells for the electrolysis of aqueous salt solutions. More particularly, this invention relates to apparatus for securing a fabricated diaphragm to an electrode.

For years commercial diaphragm cells have been used for the production of chlorine and caustic soda which employed a deposited fiber diaphrgm, usually asbestos. While quite satisfactory for producing chlorine, the caustic soda was of a relatively low concentration and contained considerable amounts of undesired sodium chloride.

Recently materials have been produced which may be employed as diaphragms to produce caustic soda of increased concentration while significantly reducing the sodium chloride content. These materials, having ion exchange properties, are produced from one or a combination of polymeric materials. The materials may be fabricated in the form of continuous sheets to extend over a group of electrodes. They may also be produced in the form of an envelope or glove which is attached to individual electrodes. It is important that the attachment of the fabricated diaphragms be accomplished in a manner which will effectively seal the diaphragm to prevent undesired leakage into or out of the electrode compartment. Leakage resulting from poor seals along seams or joints can result in a substantial reduction in current efficiency.

It is known in the prior art to attach fabricated diaphragms, for example, by means of clamps or expansible retainers. U.S. Pat. No. 1,797,377 employs clamps having offset claws which straddle two ends of the diaphragm covered electrode, pinching them together and pressing the edges between the clamp and a support plate. This method does not effectively seal the area across the top of the electrodes and requires a diaphragm be separately clamped to each electrode with no cooperation between adjoining clamps.

Flexible retainers are employed to secure a diaphragm in U.S. Pat. No. 3,878,082 where a U-shaped compressible retainer is used in combination with a crescent-shaped expansible retainer. The crescent-shaped retainer is placed over the diaphragm in the area between adjacent cathodes so that one end extends over a portion of one cathode and the other end covers a portion of the adjacent cathode. The U-shaped retainer is placed on top of the cathode so that it clamps down over one end each of two adjacent crescent-shaped retainers.

However, the use of flexible materials has been found to provide insufficient sealing between the various components and the edges of the diaphragm as the materials relax under pressure. In addition, where the components are joined, complex planes of mating surfaces are formed which do not adequately seal to prevent leakage.

Improved apparatus is therefore required which can be used to effectively secure a fabricated diaphragm to one or a plurality of electrodes and which will permit cooperation between components of the apparatus.

It is an object of the present invention to provide novel apparatus useful in diaphragm electrolytic cells for the production of chlorine and alkali metal hydroxides.

An additional object of the present invention is to provide novel apparatus for securing a fabricated diaphragm to an electrode.

A further object of the present invention is to provide novel apparatus for securing a fabricated diaphragm which can be assembled outside of the diaphragm electrolytic cell.

These and other objects of the present invention are accomplished in apparatus for securing a fabricated diaphragm to each of a plurality of foraminous electrodes positioned parallel to and having a space between each electrode. The electrodes form an electrode section, having a first side opposite a third side and a second side opposite a fourth side. The diaphragm encloses each electrode and has an open end with two adjoining edges. The apparatus comprises two bars, one positioned along the first side and one positioned along the third side of the electrode section. A plurality of clamping elements are positioned in the space between the electrodes with each clamping element being adjacent to one of the bars. Attachment means attach each clamping element to one of the bars and one adjoining edge of each of two adjacent diaphragms is sealed between the clamping element and the clamping bar.

Accompanying FIGS. 1–2 illustrate the novel apparatus for attaching diaphragms of the present invention. Corresponding parts have the same numbers in all figures.

Figure 2:
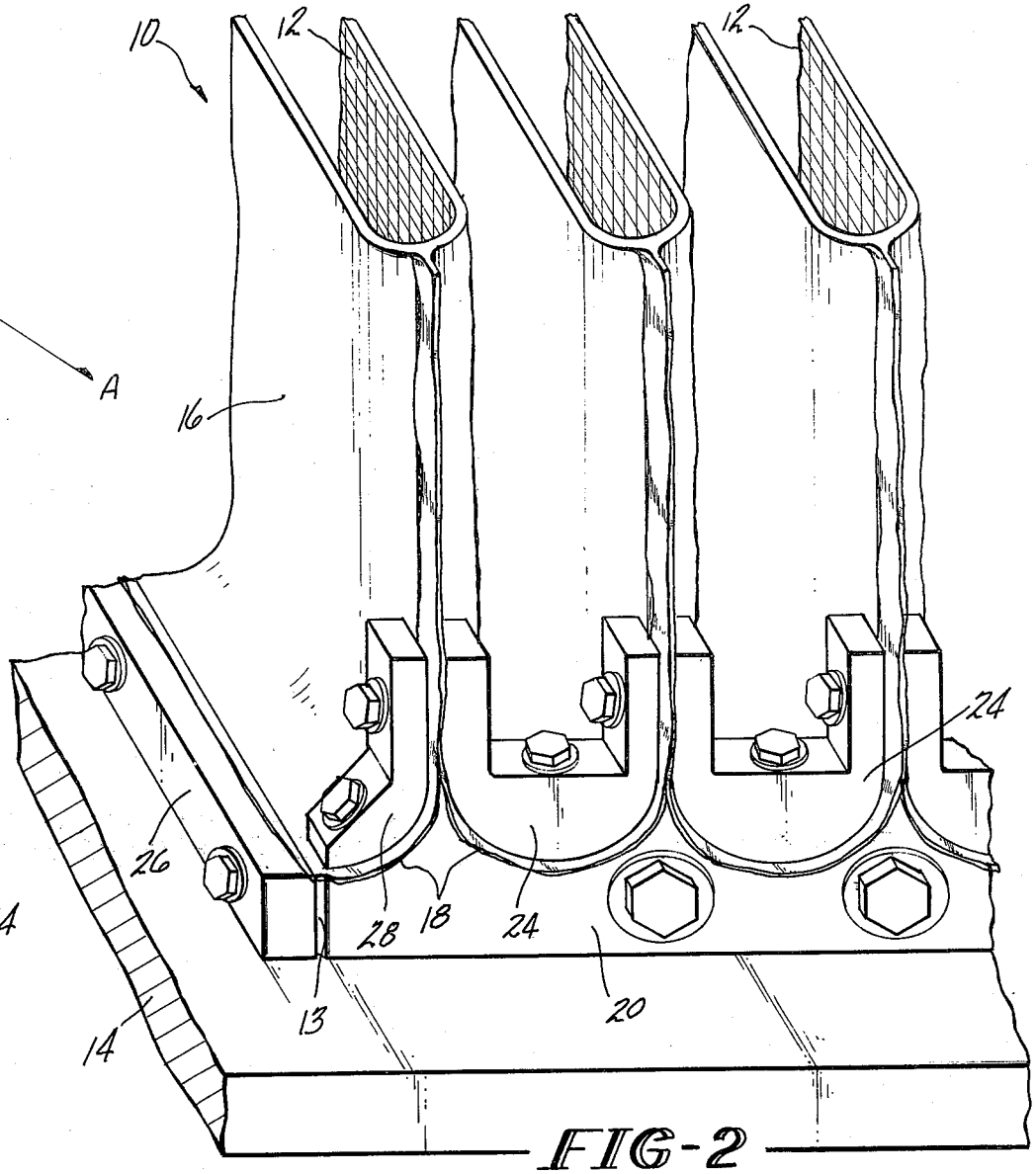
FIG. 2 is a plan perspective of assembly A according to FIG. 1.
Figure 1:
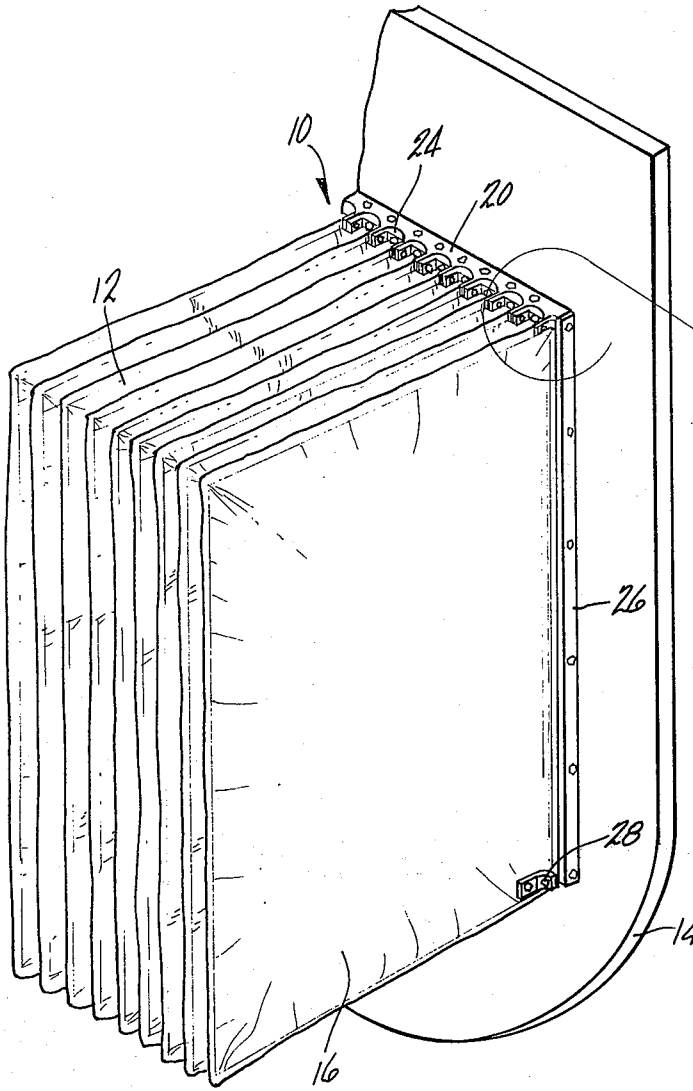
FIG. 1 illustrates a side view in perspective of a portion of an electrode section with the diaphragm attached.

FIGS. 1 and 2 illustrate a portion of electrode section 10 having a plurality of electrodes 12 attached to electrode plate 14. Diaphragms 16, in the form of envelopes, are closed along three edges and open along one edge. Diaphragms 16 enclose electrodes 12 with open edge 18 being adjacent to electrode plate 14. Bar 20 is bolted to the upper edge of electrode section 10. U-clamps 24, inserted in the space between adjacent electrodes 12, is bolted to bar 20 to seal an open edge 18 of each of two adjacent diaphragms 16. Rod 26 is bolted to outside edge 13 of electrode section 10 to seal an open edge 18 of diaphragm 16 along outside edge 13. J-clamp 28 is bolted to bar 20 to seal open edge 18 of diaphragm 16 along the top edge of electrode section 10. Adjacent U-clamps 24 are also bolted to each other and J-clamp 28 is bolted to the adjacent U-clamp 24.

Figure 3:
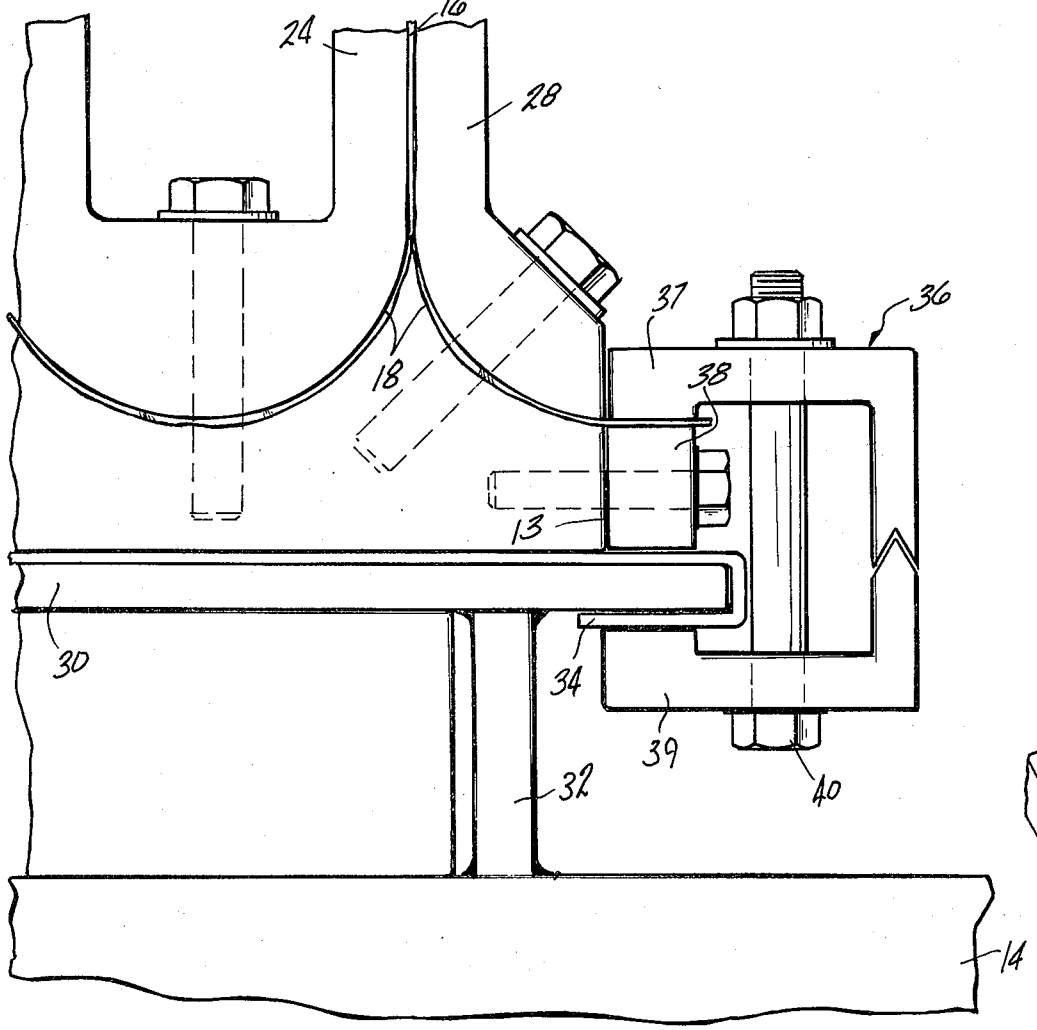
FIG. 3 shows a plan view of an alternate embodiment of FIG. 2 for attaching a diaphragm to an electrode.

FIG. 3 shows a portion of electrode section 10 having a base 30 which extends beyond outer edge 13 of electrode section 10. Support 32 attaches and spaces apart base 30 from electrode plate 14. Gasket 34 is positioned between base 30 and bar 20. Clamp 36 has upper section 37, middle section 38 and lower section 39. Middle section 38 is bolted to outer edge 13 of electrode section 10. Upper section 37 is held against middle section 42 and lower section 39 and middle section 42 are held against base 30 by bolt 40, with gasket 34 enclosing base 30. Diaphragm 16 is sealed between upper section 37 and middle section 38 of clamp 36.

Figure 4:
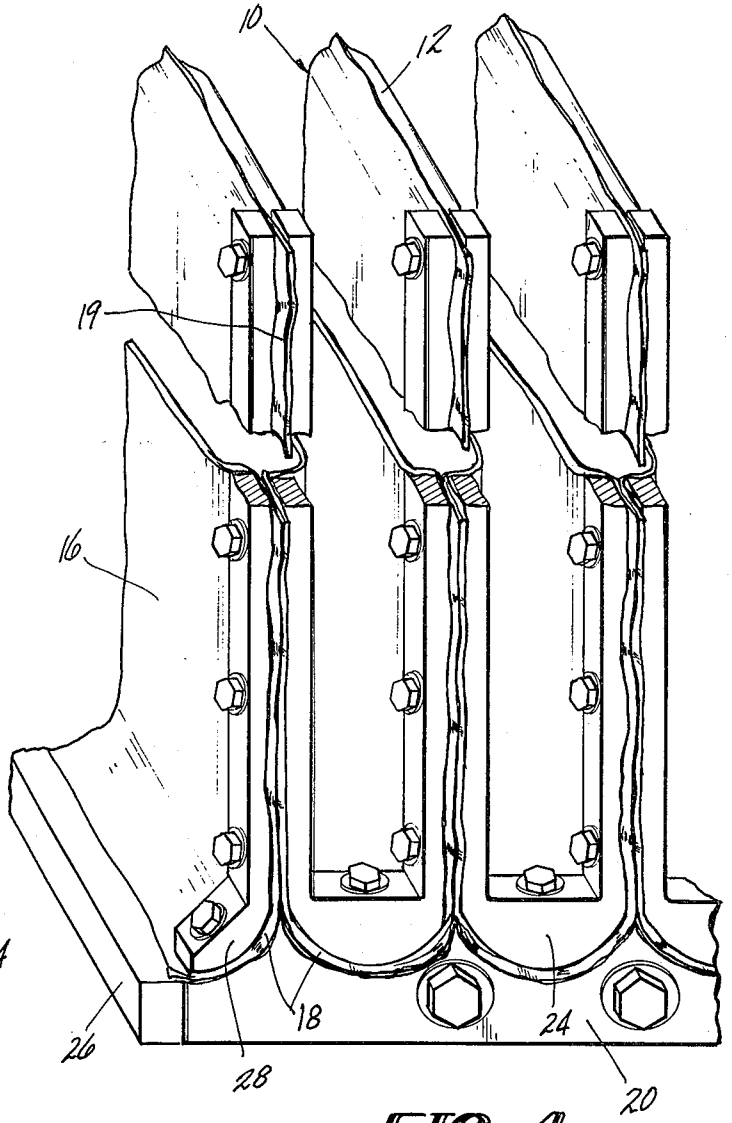
FIG. 4 illustrates a side view in perspective of a portion of an electrode section employing an additional embodiment for attaching the diaphragm.

In FIG. 4, diaphragm 16 is open along edges 17 and 18. U-clamps 24 and J-clamps 28 have arms extending along the length of electrodes 12. Edges 17 are sealed between the extended arms of adjacent U-clamps 24 which are bolted together at intervals along the extended arms. Edge 17 of the diaphragm enclosing the external cathode is sealed between J-clamp 28 and the adjacent U-clamp 24 by bolting extended arms together. Open edges 18 of diaphragm 16 adjacent to electrode plate 14 are sealed. between U-clamps 24 and bar 20 or J-clamp 28 and bar 20.

The bars positioned along the upper and lower edge of the electrode section may be attached to the edge of the electrode section or to the electrode plate. Any suitable means of attachment such as bolting may be used which will permit the bars to be removed when desired. In a preferred embodiment, the bars are attached to the edges of the electrode section as this permits the assembly of the diaphragm enclosed electrodes into the electrode section outside of the cell.

Any material of construction may be used for the bars which is inert to the electrolytes and gases present in the cell. Suitable materials include metals such as titanium or plastics such as polytetrafluoroethylene or polyvinyl chloride. When an electrically conductive material is used, it should be insulated from the cathode by inserting a non-conductive gasket. The bars should have little flexibility to provide a solid surface against which to secure the diaphragm. The bars may have one or more openings for attaching the clamping elements. A preferred embodiment of the bar has scallops or the like along the edge to which the clamping elements are attached.

The clamping elements are removably and adjustably attached to the bars or to the electrode plate by any suitable means such as bolting. The elements are positioned in the space between adjacent electrodes and seal one edge of each of two adjacent diaphragms against the bars. While any suitable form may be used for the elements, for example, wedges, ellipses, parabolas, etc., a preferred embodiment is a U-shaped element with the curved portion attached to the bar and the arms positioned substantially perpendicular to the electrode plate as illustrated in FIG. 2.

A preferred embodiment provides means for attaching adjacent clamping elements to each other to provide additional sealing of the diaphragm edges. Suitable adjustable attachment means such as bolting may be employed.

Where the diaphragm has two open edges, the arms of the clamping elements may be extended along the entire length of the electrode, as shown in FIG. 4. One open edge is sealed between one arm of each of two adjacent clamping elements by, for example, bolting the arms together at selected intervals.

Rods may be employed to seal the outer edge of the diaphragms enclosing the two electrodes positioned at the end of the electrode section. The rods are suitably attached to sides of the electrodes by bolting or the like and seal the diaphragm against the electrode. A clamping element is attached at the upper and lower ends of the rod to further seal the diaphragm edges. The elements may be, for example, C or J-shaped and be attached to the adjacent clamping element as illustrated in FIG. 2.

The novel clamping apparatus of the present invention may be used with diaphragm electrolytic cells in which the electrodes are the finger type as shown, for example, in U.S. Pat. No. 2,370,086, issued Feb. 20, 1945, to Stuart, or those in which the electrodes are of tubular construction spanning the cell, see for example, U.S. Pat. No. 3,493,487, issued Feb. 3, 1970 to Ruthel et al. A preferred type of cell is that in which both anodes and cathodes are finger-like and are attached to electrode plates positioned vertically, as illustrated by U.S. Pat. No. 3,477,938, issued Nov. 11, 1969, to Kircher.

While diaphragms normally enclose the cathodes, the novel apparatus of the present invention may also be used to seal the diaphragms to the anodes.

Any suitable diaphragm or membrane material may be sealed to an electrode using the appartus of the present invention with the provision that the diaphragm be fabricated prior to its being attached to the electrodes, for example, in sheet or tube form. Thus both hydraulically permeable and hydraulically non-permeable materials may be used.

Hydraulically permeable diaphragms are composed of an inert material which is fluid permeable and resistant to either halogen or alkali metal ions. The diaphragm may be a woven fabric, for example, of polymeric materials such as polyethylene, polypropylene or polytetrafluoroethylene. The diaphragm may also be an ion exchange membrane or a composite of an ion exchange resin reinforced by a screen of a suitable metal or fabric. A preferred hydraulically permeable diaphragm material is a perfluorocarbon polymer composite membrane composed of a copolymer of tetrafluoroethylene with a sulfonated perfluorovinyl ether supported on a polyfluoro-olefin cloth. This composite membrane is sold commercially by E. I. DuPont de Nemours and Company under the trademark "Nafion".

The electrode section is comprised of a plurality of electrodes of from about three to about 100 and preferably from about five to about 50 electrodes. The electrodes are positioned parallel to and separated from each other. The assembled electrode section is attached to an electrode plate using known methods such as bolting the electrodes to the electrode plate. The electrode plate may be positioned vertically or horizontally and has conductors attached and adapted to supply electric current to the electrodes.

The electrolytically active areas of the electrode are foraminous surfaces. Where the electrode serves as a cathode, the electrode surface is suitably a metal screen or mesh where the metal is one resistant to caustic alkalies, for example, iron, steel, nickel, or tantalum.

Where the diaphragm enclosed electrode is an anode, the foraminous anode surface may be in various forms such as an expanded mesh which is flattened or unflattened, and having slits horizontally, vertically or angularly. Other suitble forms include woven wire cloth, which is flattened or unflattened, bars, wires, or strips arranged, for example, vertically, and sheet or plates having perforations, slits or louvered openings.

A preferred anode surface is a foraminous metal mesh which is a good electrical conductor. It is preferred to employ a valve metal such as titanium or tantalum or a metal, for example, steel, copper or aluminum clad with a valve metal such as tantalum or titanium. The valve metal has a thin coating over at least part of its surface of a platinum group metal, platinum group metal oxide, an alloy of a platinum group metal or a mixture thereof.

If desired, liquid sealants such as silicone sealants may be used in addition to the clamping apparatus for sealing the open edges of the diaphragms.

The apparatus of the present invention provides means for completely sealing the open edges of fabricated diaphragms enclosing electrodes along the outer edges of the electrode section. Leakage of anolyte into the cathode compartment or of hydrogen into the chlorine are completely prevented when employing the novel apparatus. Sealing of the open edges of the diaphragms between those portions secured by the novel apparatus of the present invention can be accomplished by means such as the application of sealants, or by heat sealing.

Installation of the diaphragms on the electrode fingers and subsequently sealing the open edges is accomplished by attaching the bars to the top and bottoms of the electrode section or directly to the electrode plate at the desired locations. The diaphragm, closed along at least two edges, is sized so that it will slip over the electrode finger and fit snuggly around it with the open ends of the diaphragm contacting the electrode root structure, that portion adjacent and attached to the electrode plate. If desired, where the diaphragm material is hydraulically permeable it may be wetted, for example, with water, prior to being slipped on the electrode finger. The clamping elements are then positioned and attached to the bars and interconnected with adjacent clamping elements to seal the edges of the diaphragm. Rods are then attached along the outside edge of the outermost electrodes in the electrode section.

What is claimed is:

1. Apparatus for securing a fabricated diaphragm to each of a plurality of foraminous electrodes positioned substantially parallel to each other and having a space between each of said electrodes, said electrodes forming an electrode section, said electrode section having four adjoining sides, a first side opposite a third side, and a second side opposite a fourth side, said diaphragm enclosing each of said electrodes and having an open end with two adjoining edges, wherein said apparatus is comprised of:

1. two bars, one of said bars being positioned along said first side and the other being positioned along said third side of said electrode section,
2. a plurality of clamping elements wherein each said clamping element is positioned in said space between two of said electrodes and adjacent to one of said bars,
3. attachment means for attaching each of said clamping elements to one of said bars wherein one said adjoining edge of each of two adjacent diaphragms is sealed between said clamping elements and said bars.

2. The apparatus of claim 1 wherein said clamping elements have means for inter-connecting with adjacent clamping elements.

3. The apparatus of claim 1 wherein said bars are attached to said first and said third sides of said electrode section.

4. The apparatus of claim 1 wherein said clamping elements are U-shaped with the arms of said U positioned substantially perpendicular to said bars.

5. The apparatus of claim 4 wherein an electrode plate supports said electrode section, said electrodes having means for attachment to said electrode plate.

6. The apparatus of claim 4 wherein an edge of said bars parallel to and spaced apart from said electrode plate is scalloped.

7. The apparatus of claim 6 wherein a first rod is positioned along said second side and a second rod is positioned along said fourth side of said electrode, attachment mens to attach said rods to said sides, said rods sealing one said adjoining edge of said diaphragm enclosing the outermost electrodes of said electrode section against said sides.

8. The apparatus of claim 7 wherein said attachment means for said clamping elements is attached to said scalloped edge of said bar and said electrodes are cathodes.

9. The apparatus of claim 8 wherein said electrode plate is positioned vertically.

10. The apparatus of claim 8 wherein said electrode plate is positioned horizontally.

11. The apparatus of claim 1 wherein said bars are electrically conductive and a gasket is interposed between said bars and said electrode section.

12. A method for securing a fabricated diaphragm to each of a plurality of foraminous electrodes positioned substantially parallel to each other and having a space between each of said electrodes, said electrode forming an electrode section, said electrode section having four adjoining sides, a first side opposite a third side, and a second side opposite a fourth side, wherein said method is comprised of:

1. attaching two bars to said electrode section one of said bars being attached along said first side and the other being attached along said third side of said electrode section,
2. enclosing each of said electrodes with a diaphragm having an open end with two adjoining edges,
3. inserting a plurality of clamping elements wherein each said clamping element is positioned in said space between two of said electrodes and adjacent to one of said bars,
4. attaching each of said clamping elements to one of said bars wherein one said adjoining edge of each of two adjacent diaphragms is sealed between said clamping elements and said bar.

* * * * *